US007020388B2

(12) United States Patent
Mills

(10) Patent No.: US 7,020,388 B2
(45) Date of Patent: Mar. 28, 2006

(54) WATER HEATING DEVICE WITH LIGHT BULB HEAT SOURCE WHOSE LIGHT IS TRANSFERRED TO ANOTHER LIGHT RECEIVING DEVICE

(75) Inventor: Marcus A Mills, 610 Wilson Blvd. S., Naples, FL (US) 34117

(73) Assignee: Marcus A Mills, Naples, FL (US)

( * ) Notice: Subject to any disclaimer, the term of this patent is extended or adjusted under 35 U.S.C. 154(b) by 0 days.

(21) Appl. No.: 10/782,454

(22) Filed: Feb. 20, 2004

(65) Prior Publication Data

US 2005/0185941 A1 Aug. 25, 2005

(51) Int. Cl.
*F24H 1/00* (2006.01)
*H05B 3/00* (2006.01)

(52) U.S. Cl. ..... 392/483; 392/481; 392/407; 250/504 R

(58) Field of Classification Search ..... 392/483, 392/480–481, 407; 137/341; 250/504 R
See application file for complete search history.

(56) References Cited

U.S. PATENT DOCUMENTS

| | | | | | |
|---|---|---|---|---|---|
| 1,819,941 | A * | 8/1931 | Brown | ..... | 604/114 |
| 2,357,286 | A * | 9/1944 | Reavell | ..... | 392/387 |
| 2,607,877 | A * | 8/1952 | Stevens | ..... | 392/483 |
| 3,813,514 | A * | 5/1974 | Canty | ..... | 392/460 |
| 5,054,107 | A * | 10/1991 | Batchelder | ..... | 392/483 |
| 2003/0216689 | A1* | 11/2003 | Bouhuijs et al. | ..... | 604/113 |
| 2004/0184794 | A1* | 9/2004 | Johnson et al. | ..... | 392/483 |

FOREIGN PATENT DOCUMENTS

| | | | | |
|---|---|---|---|---|
| DE | 3707486 | * 10/1987 | | |
| DE | 269654 | * 7/1989 | ..... | 392/483 |
| DE | 4139288 | * 4/1992 | | |
| FR | 580613 | * 11/1924 | ..... | 392/483 |
| JP | 52-51764 | * 4/1977 | ..... | 392/483 |
| JP | 7-98153 | * 4/1995 | | |

* cited by examiner

*Primary Examiner*—John A. Jeffery

(57) ABSTRACT

Disclosed is a heat transfer system, the heat emanating from a regular light bulb wherein the heat generated by the filament within the glass of the light bulb is generally wasted by exposure to the environment. The regular light bulb is surrounded by a metallic heat shield in close proximity to the light bulb. The heat shield itself is surrounded by a coiled tubing having a medium that will heat because of the influence of the heat from the light bulb. The heated medium will be transferred to another location to heat another medium such as water, for example. The light will also be transferred to another light emitting source to light a predetermined area. The light transfer may be accomplished by a glass fiber optic cable which will transfer the light energy from the initial light source, the light bulb, to a new source of a light receiving device.

4 Claims, 2 Drawing Sheets

WATER HEATING DEVICE WITH LIGHT BULB HEAT SOURCE WHOSE LIGHT IS TRANSFERRED TO ANOTHER LIGHT RECEIVING DEVICE

REFERENCE TO RELATED APPLICATIONS (none)

STATEMENT REGARDING FED SPONSORED R & D (none)

BACKGROUND OF THE INVENTION

The inventive concept includes the realization that regular light bulbs known as emitting white light, waste a lot of heat that is created by the filament inside the light bulb. The filament's only purpose is to emit a bright glow that is used to create a light to be transmitted to the surrounding environment but for no other reason.

SUMMARY OF THE INVENTION

An object of the invention is to capture the heat that is generated by the white light of a light bulb which normally would go to waste by being spread into the surrounding environment. If the heat that is generated by the filament in the light bulb could be captured and put to a different use, this invention would be quite an improvement over what has been known before.

DETAILED DESCRIPTION OF THE INVENTION

Figure 1:
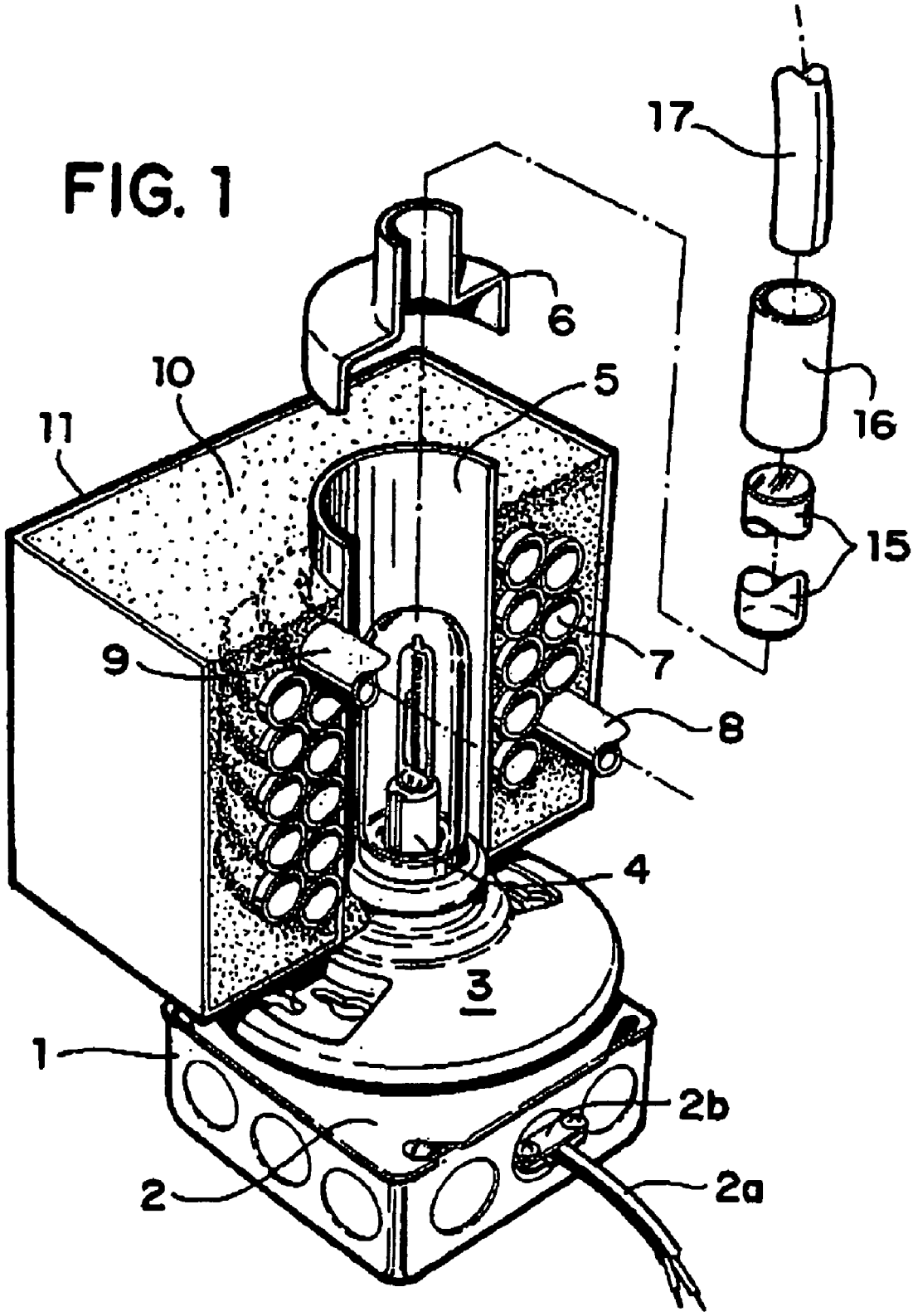
FIG. 1 shows a perspective view of the overall concept of the invention.

FIG. 1 illustrates the invention in a perspective view wherein the basic electric box is shown at 1. It is well known to cover the electric box by way of a cover 2.

Normally, a ceramic light bulb fixture 3 is attached to the cover 2. The ceramic light bulb fixture 3 has a light bulb 4 screwed into same. The tight bulb fixture 3 and light bulb 4 can be used in many different installations. However, in any installation, the light bulb 4 is emitting heat that is being wasted.

Therefore, this invention concept will capture the heat generated by the light bulb and use the captured heat to generate the use of a different energy source. To this end, the light bulb 4 is surrounded by a metal sleeve 5 which will capture the heat emanating from the light bulb 4. The metal sleeve will capture the heat from the light bulb 4 and transfer the heat to the surrounding coil tube 7 which contains a heating medium such as water as a liquid medium or any other vapor medium known to be usable as a heat transfer. The heating coil 7 has an inlet 9 and outlet 8. The total of the heating coil 7 is surrounded by an insulating medium 10, such as fiber glass or any other medium, which is contained a container 1. The metal sleeve 5, which surrounds the heat emitting light bulb 4 has an adapter cap 6 attached to its top to capture and transport the light to a different location by way of a fiber optic cable 17 to an area where a lighting is desired. The fiber glass optic tube is connected by way of the adapter connector 16 to a glass fiber optic tube 17 to a light emitting device (not shown). The outlet 8 with its heated medium will continue to some other device where heat is required such as a hot water heater, a space heater and any other device. The electric power for the light bulb 4 is supplied by the electric cord 2*a* being attached to the electric box 2 by way of a clamp 2*b*.

Figure 2:
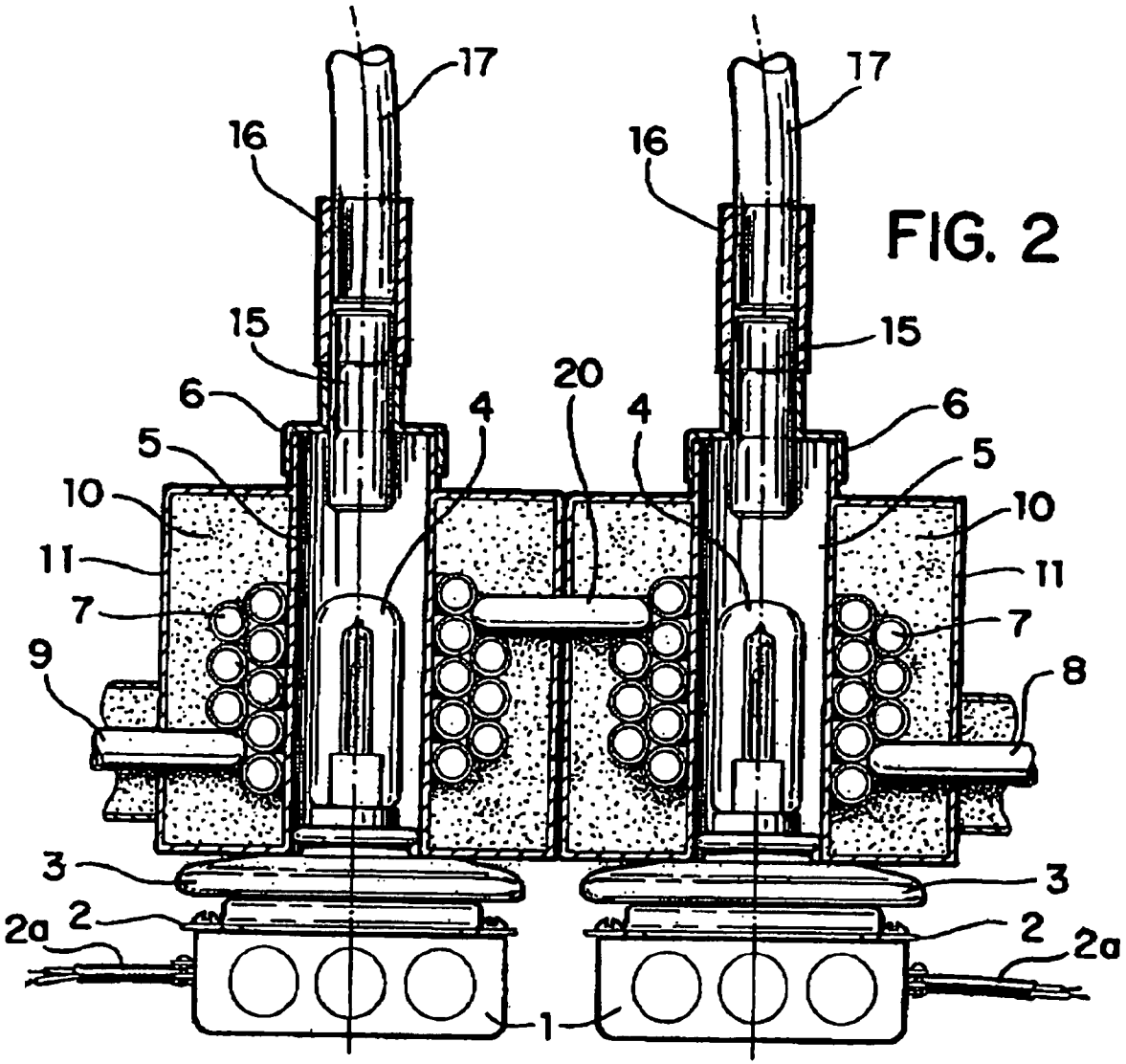
FIG. 2 illustrates a duplication of the device of FIG. 1.

Turning to FIG. 2 where like reference characters have been applied to the same reference characters that where used and shown in FIG. 1. This embodiment of FIG. 2 shows a duplication of the device of FIG. 1. This concept, even shown as a duplicate intensifies the heat transferred from one unit to the next. The transfer tube 20 will accomplish this transfer to the next heating coil wherein the previously heated medium will be heated into a next higher stage. Of course, it is possible to increase the heat generation of one unit to the next by placing more than one unit in a serial connection to another adjacent unit next to each other.

CONCLUSION OF THE INVENTION

It can be now be seen that the heat generated by a regular light bulb can be used as a subsequent source of energy to accomplish a different purpose which was not intended by the first use. Thus, the second source of energy comes from the use of the heat generated by the bulb.

I claim:

1. A heat converting system including a heat source, said heat source is a regular light bulb, a shield surrounding said light bulb, said shield is collecting the heat from said light bulb, said heat is transferred to a heat receiving device surrounding said shield, said heat receiving device is a water heating device, said shield is covered by an adapter cap to collect light from said light bulb and to transmit said light to a light receiving source.

2. The heat converting system of claim 1, wherein said heat receiving device is a coil containing water.

3. The heat converting system of claim 1, wherein said collecting of said light constitutes a fiber optic cable.

4. The heat converting system of claim 1 including a second heat converting system coupled to said heat converting system in a series arrangement.

* * * * *